US005882040A

United States Patent [19]

Binder

[11] Patent Number: 5,882,040

[45] Date of Patent: Mar. 16, 1999

[54] SKI STOCK SET

[76] Inventor: Johann Binder, Haselberg 76, D-94164 Sonnen, Germany

[21] Appl. No.: 871,451

[22] Filed: Jun. 9, 1997

[30] Foreign Application Priority Data

Jun. 18, 1996 [DE] Germany ..... 196 24 190.1

[51] Int. Cl.[6] ..... A63C 11/10

[52] U.S. Cl. ..... 280/820; 280/819

[58] Field of Search ..... 280/809, 814, 280/816, 819, 820, 824; 403/100, 101, 102, 157

[56] References Cited

U.S. PATENT DOCUMENTS

| | | | |
|---|---|---|---|
| 132,188 | 10/1872 | Topliff et al. | 403/157 |
| 445,631 | 2/1891 | Smith | 403/157 |
| 1,614,949 | 1/1927 | Finely | 403/157 |
| 2,290,161 | 7/1942 | Bosworth | 403/157 |
| 2,400,032 | 5/1946 | Talbot | 403/157 |
| 2,603,981 | 7/1952 | Snyder | 403/157 |
| 5,178,583 | 1/1993 | Rankin | 403/100 |

FOREIGN PATENT DOCUMENTS

| | | | |
|---|---|---|---|
| 3814383 | 11/1989 | Germany | 280/814 |
| 636530 | 6/1983 | Switzerland | 280/819 |

*Primary Examiner*—Kevin Hurley
*Assistant Examiner*—Michael Cuff
*Attorney, Agent, or Firm*—Hoffman, Wasson & Gitler

[57] ABSTRACT

The invention relates to a novel ski pole set whereby at least two ski poles form a ski carrier having pole disks which function as freely rotatable wheels for the device.

4 Claims, 4 Drawing Sheets

SKI STOCK SET

BACKGROUND OF THE INVENTION

The invention relates to a set of ski poles. Two ski poles are each provided with a grip on their lower end. Each pole has a disk on its end which can turn freely around its axis. In addition, the lower end of the pole forms an extension which can move between a first position in which the pole end forms an extension of the ski pole for a position in which the pole tip is transverse or perpendicular to the axis of the pole element.

A ski pole set with various features is known (CHH 636530). The known ski pole set consists of two ski poles which each have on the lower end of a pole element, a lower pole part which encompasses the pole tip with the disk. The lower ski pole part can swivel around an axis parallel to the axis of the pole tip on the pole element between a first position in which the pole tip forms the extension of the pole element, and a second position in which the axis of the pole tip is transverse or perpendicular to the longitudinal axis of the pole element. On the swivelling ski pole part, on one ski pole, is a sleeve-like connecting element which can be moved axially between an out-of-use position and an in-use position. In the in-use position the sleeve-like connecting element, with one end, stands radially apart from its pole element, when the lower part of the one ski pole is swivelled into the second position. When the lower part of the other ski pole is likewise swivelled into the second position, the lower ski pole parts of the two ski poles can be joined to one another via this connecting element such that the ski poles form a transport aid for the ski in the form of a carriage. In contrast, here, the lower pole parts which have been swivelled to the outside and which are joined to one another via the connecting element form the axis and the disks of the two ski poles form the wheels of the carriage-like transport aid which can turn around this axis.

The object of the invention is to devise a ski pole set which enables simplified handling.

SUMMARY OF THE INVENTION

To achieve this object, a ski pole set having disks which can freely rotate and act as wheels is provided to enable carriage-like transport. The poles can be detachably joined together when the lower ends are in the transverse position by a connecting element and coupling pieces.

The invention is detailed below using the figures which illustrate a preferred embodiment.

DETAILED DESCRIPTION OF THE INVENTION

Figure 1:
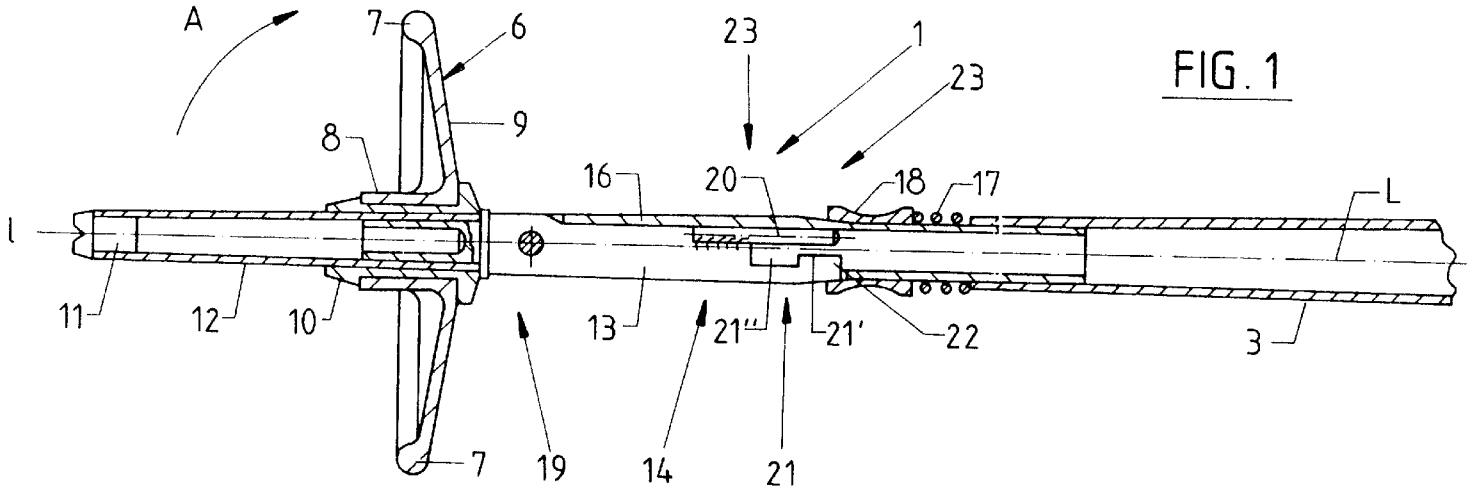
FIG. 1 shows in a side view and partially in a longitudinal section the lower end of one of the two ski poles of the ski pole pair.
Figure 2:
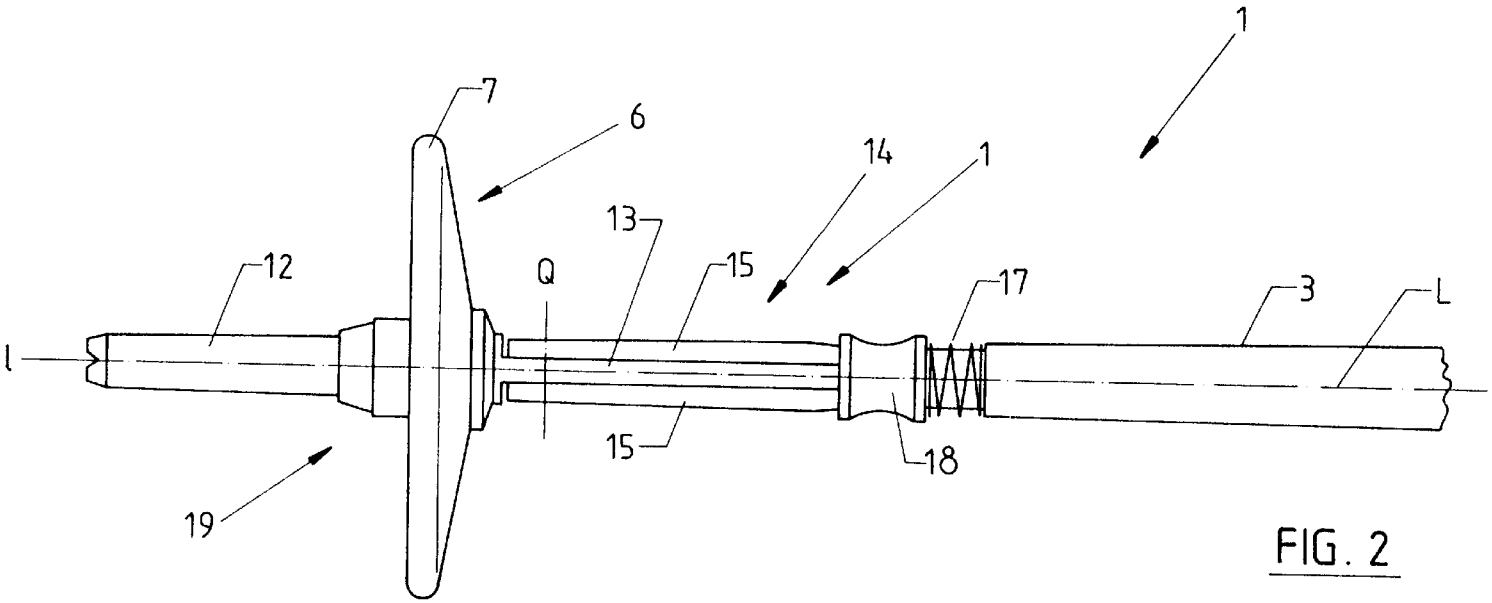
FIG. 2 shows a view like FIG. 1, but when the ski pole has been turned 90 degrees around the longitudinal axis.
Figure 4:
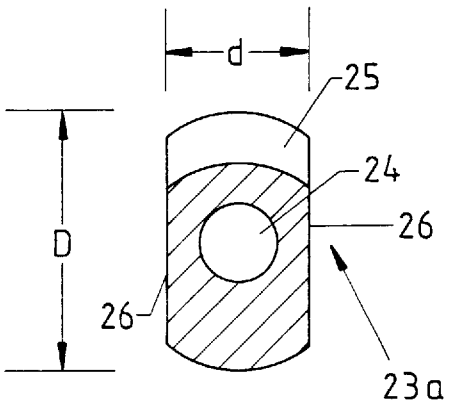
FIG. 4 shows a section corresponding to line I—I of FIG. 3.
Figure 3:
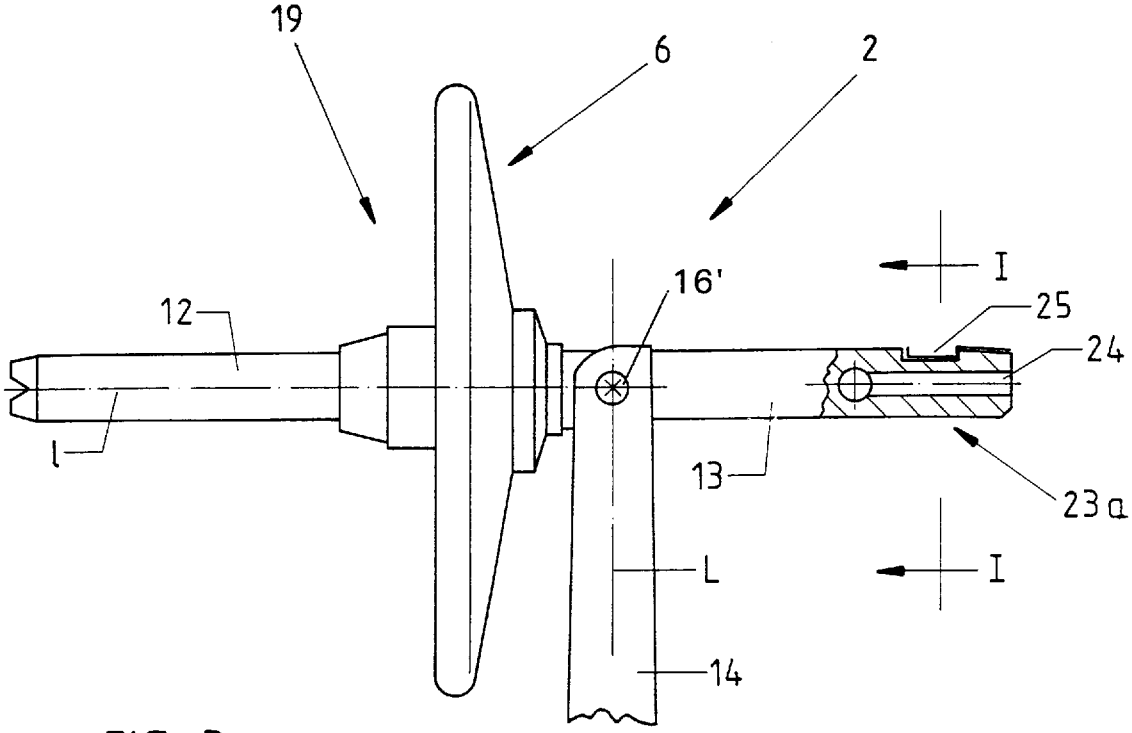
FIG. 3 shows the lower end of the second ski pole of the ski pole pari in an individual representation.

In the Figures, the ski poles of a ski pole pair are labelled 1 and 2. Ski poles 1 and 2 include pole element 3 which is produced from a tube section and on which on one end (upper end of ski pole 1 or 2) there is conventional grip 4 with loop 5. On the other, each ski pole, 1 or 2, has a conventional disk 6 which for each of ski poles 1 and 2 is made as a loadable wheel which is pivotally mounted on the pertinent end of ski poles 1 and 2. Respective disk 6, which is made for example for plastic, has a circular disk edge 7 and a middle, sleeve-like hub 8, and a disk element 9, which is made in the shape of a truncated cone, which joins disk edge 7 and hub 8 to one another, and which is made concave on the side facing the adjacent end of ski pole 1 or 2. Each disk 6 is produced from plastic in one piece with disk edge 7, hub 8 and disk element 9. Each disk 6 is held using hub 8 by catching on a bearing element 10, which can be produced from plastic and which can turn freely around the axis of the disk 6.

Sleeve-like bearing element 10 sits on a tube section, which is closed on the free end by insert 11, which forms pole tips 12 of ski pole 1 and 2, and which passes on its end which is located in the area of disk 6 and which faces away from insert 11 into connecting element 13 made of a flat material. The longitudinal extension of connecting element 13 and the axis of pole tip 12 around which respective disk 6 can turn, lie axially identical with one another. In the figures, the longitudinal axis of pole element 3 is labelled L and the longitudinal axis of pole tip 12 and of connecting element 13 is labelled I.

Pole element 3 continues on its end away from grip 4 in bearing piece 14 which extends with one end for attachment on pole element 3 into the latter and is joined there in a suitable manner to pole element 3. The bearing piece 14 is made in a fork shape on its other end, with two fork arms 15. Between these fork arms 15, by means of hinge pin 16', respective connecting element 13 can swivel around transverse axis Q perpendicularly to longitudinal axis L between a first position in which axis I lies axially identical to longitudinal axis L and a second position in which axis I is perpendicular to longitudinal axis L. In the embodiment shown, two fork arms 15 on one side of the jacket surface of bearing piece 14, are joined to one another by wall section 16 so that swivelling of each connecting element 13 to permanent pole tip 12 and disk 6 which is supported to turn there from the first position shown for example in FIG. 1 is possible only in one direction, specifically in the direction illustrated in FIG. 1 with arrow A. Swivelling in the other direction of the connecting element out of the first position is opposed by wall section 16. Bearing piece 14, with fork arms 15, and wall section 16 is made in one piece. Slide means 18, which is pretensioned by spring 17, and which can be moved on bearing piece 14 in the longitudinal direction, and which interacts with the free end of connecting element 13 when the latter is located in the first position, allows swivelling pole part 19 which has disk 6 and which can be swivelled by connecting element 13 of pole tip 12, to be locked in the first swivel position. Pole tip 12, with connecting element 13, and the elements provided there from lower swivelling ski pole part 19.

Two ski poles 1 and 2 of the ski pole pair are made such that the free ends of connecting elements 13 form a quick acting closure (coupling pieces 23 or 23*a*) with which these ends can be joined to one another when swivelling ski pole parts 19 are swivelled into the second position (axis I perpendicular to longitudinal axis L). For this reason, on the free end of connecting element 13 of ski pole 1 to form coupling piece 23 there is metal pin 20 which lies with its axis parallel to axis I. For this metal pin 20 connecting element 13 is relieved such that between metal pin 20 joined only on one end to connecting element 13 opening 21 is formed between the metal pin and connecting element 13 which, in the direction of axis I and proceeding from the free end of metal pin 20 or connecting element 13, has section 21' of smaller width and adjacent thereto section 21" of greater width so that connecting element 13 in the area of section 21' form catch-like projection 22.

On the free end of connecting element 13, appropriate to this first coupling piece 23, there is second coupling piece 23*a* which has essentially one axial hole 24 axially identical to axis I and groove 25 for holding projection 22. Coupling piece 23 is furthermore formed such that in one cross sectional plane perpendicular to the axis of hole 24 cross sectional dimension D in the axis direction is greater than cross sectional dimension d in another axial direction which runs perpendicular hereto. There is groove 25 on the side with greater cross section D. The radial distance of the bottom of groove 25 from the axis of hole 24 corresponds to the radial distance of projection 22 from the axis of metal pin 20. Smaller diameter 3 on side 26 of coupling piece 23 is at most equal, but preferably somewhat smaller than twice the axial distance between the bottom of groove 25 and the axis of hole 24, so that for joining two coupling pieces 23 and 23*a* metal pin 20 is pushed into hole 24 when projection 22 is in the area of side 26, and then, by turning two coupling pieces 23 and 23*a*, projection 22 is moved laterally into groove 25. Side 26 on which coupling piece 23*a* has smaller cross sectional dimension d lies in one plane perpendicular to transverse axis Q so that for ski pole parts 19 swivelled into the second position and when coupling pieces 23 and 23*a* are joined to one another, i.e., when projection 22 fits into groove 25, axis I and longitudinal axis L two pole elements 3 lie with their longitudinal axis L parallel to one another and at a distance to one another and in a common plane with axes I.

Figure 5:
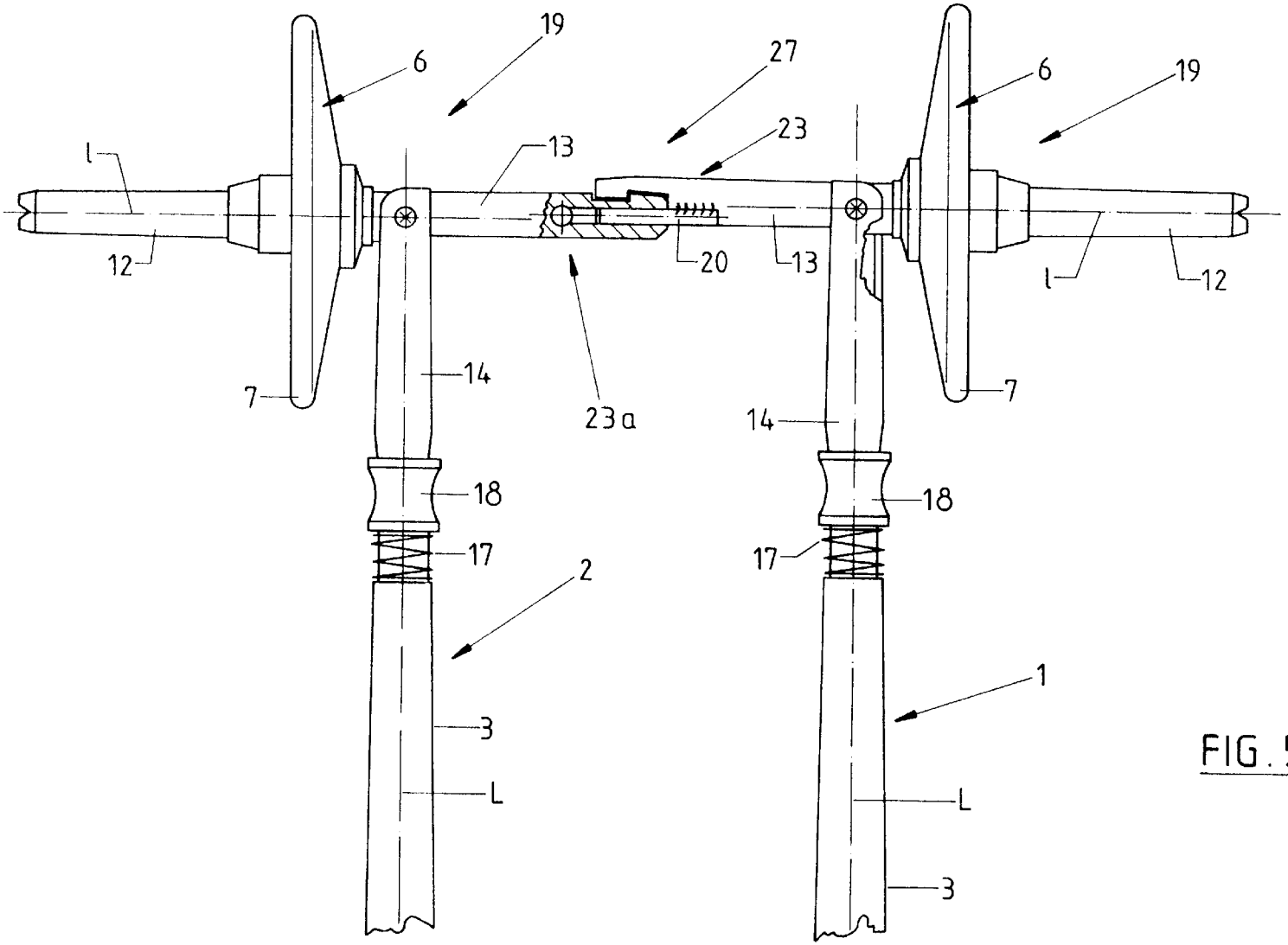
FIG. 5 shows the ski poles joined to one another to form a transport aid.
Figure 6:
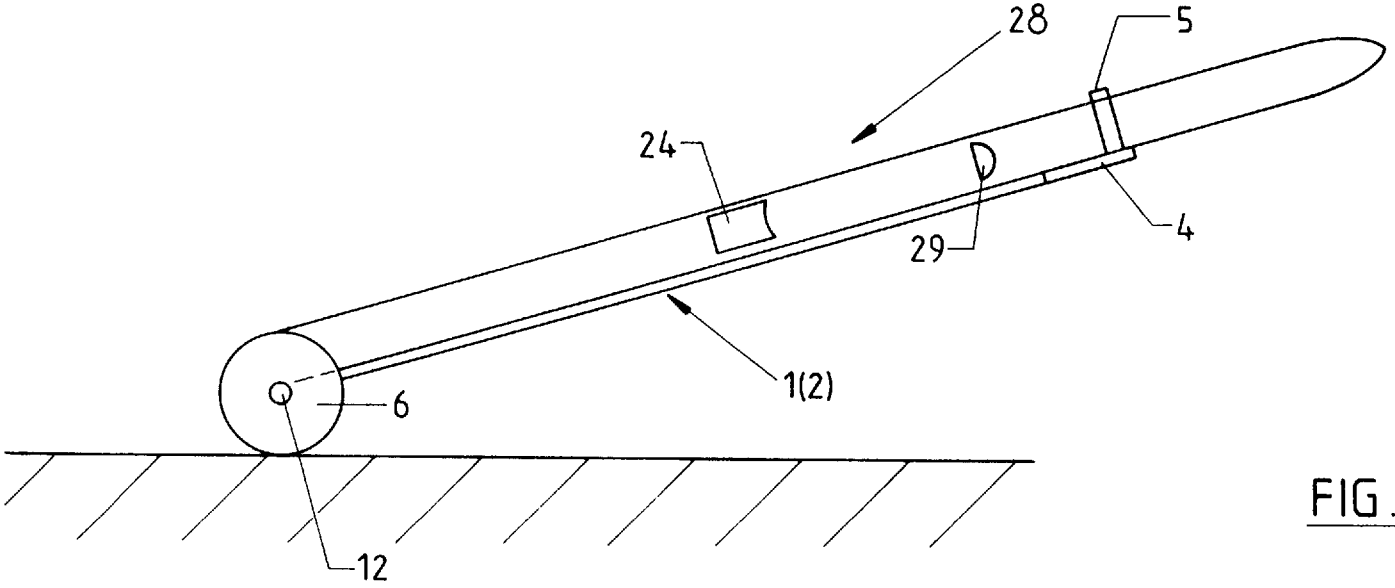
FIG. 6 shows a ski pair attached to the transport aid in a side view.

FIG. 5 shows the state in which two lower ski pole parts 19 of ski poles 1 or 2 are swivelled into the second position around respective transverse axis Q and are joined to one another via coupling pieces 23 and 23*a*. Two connecting elements 13 in this state form traverse 27 which joins ski poles 1 and 2 to one another and which extends between bearing pieces 14 of two ski poles 1 or 2. On the outside, i.e., on the sides of bearing pieces 14 which face away from one another, there are two rotary disks 6 so that a carriage-like transport aid is formed for transporting for example two skis 28 which are joined to one another via joining belts. Skis 28 are placed with their backward ski end on transverse 27, edgewise such that the planes of the running surfaces of skis 28 are perpendicular to the longitudinal extension of traverse 27 or axes I. Using bindings 29 skis 28 are supported on pole elements 3 which surround two skis 28 with loops 5 overhead. Loops 5 are joined to one another for this purpose. In this form skis 28 and two ski poles 1 and 2 converted into the carriage-like transport aid are joined to one another to form a unit which makes it possible to comfortably transport skis 28 by grasping the ski tips by tightening.

I claim:

1. A ski stock set comprising:

a first ski pole and a second ski pole, each pole having;

an upper pole element having a longitudinal axis;

a lower pole element having a longitudinal axis; said lower pole element pivotally connected to the upper pole element said lower pole element having a first end having a tip for engaging the ground and a second end opposite said first end having an extension for coupling the lower pole element to the upper pole element;

an upper and a lower pole element extension having a bayonet coupling for releasably joining the extensions together;

the lower pole element extension of the first ski pole having a male coupling; and the lower pole element extension of the second ski pole having a female coupling, the male and female couplings cooperating to releasably join the first and second ski poles to one another.

2. The ski stock set of claim 1, wherein the male coupling is a metal pin and the female coupling is an aperture.

3. The ski stock set of claim 2, wherein the metal pin has a longitudinal axis parallel to the longitudinal axis of the lower pole element.

4. The ski stock set of claim 1, wherein the male coupling is a projection extending axially inwardly and the female coupling is a groove extending axially inwardly.

* * * * *